United States Patent [19]

Backström et al.

[11] 3,937,647

[45] Feb. 10, 1976

[54] METHOD OF INCREASING CELLULOSIC PULP YIELDS IN AN ALKALINE DIGESTION PROCESS

[75] Inventors: Inga L. Backström, Stockholm; Nils J. C. Hartler, Lidingo; Knut P. Kringstad, Vallingby, all of Sweden

[73] Assignee: Svenska Traforskningsinstitutet, Stockholm, Sweden

[22] Filed: Nov. 12, 1973

[21] Appl. No.: 415,153

[30] Foreign Application Priority Data

Dec. 11, 1972 Sweden ..... 16130/72

[52] U.S. Cl. ..... 162/16; 162/61; 260/124 R

[51] Int. Cl.[2] ..... D21C 11/00

[58] Field of Search ..... 162/16, 61, ; 260/124

[56] References Cited

UNITED STATES PATENTS

| | | | |
|---|---|---|---|
| 1,859,888 | 5/1932 | Richter | 162/16 |
| 2,167,556 | 7/1939 | Smull | 162/16 |
| 2,686,120 | 8/1954 | Marshall et al. | 162/16 X |
| 2,976,273 | 3/1961 | Ball et al. | 162/16 X |
| 3,428,520 | 2/1969 | Yiannos | 162/16 |
| 3,806,403 | 4/1974 | Ferguson | 162/16 |

FOREIGN PATENTS OR APPLICATIONS

| | | | |
|---|---|---|---|
| 130,377 | 7/1947 | Australia | 162/16 |

*Primary Examiner*—Robert L. Lindsay, Jr.
*Assistant Examiner*—Arthur L. Corbin
*Attorney, Agent, or Firm*—Oldham & Oldham Co.

[57] ABSTRACT

Increased pulp yields are obtained by alkaline digestion of cellulosic material until a pulp yield of not above 65% is obtained, lowering the pH of the digestion liquid is lowered to allow 11 causing organic substances to precipitate from the digestion liquor and then continuing digestion in the presence of the pulp until at least 5% of the organic substances which have been precipitated out are absorbed by the pulp.

6 Claims, No Drawings

METHOD OF INCREASING CELLULOSIC PULP YIELDS IN AN ALKALINE DIGESTION PROCESS

The present invention relates to a method of producing high yield paper pulp by the alkaline digestion of cellulosic material.

When producing pulp from cellulosic material, such as wood for example, by alkaline digestion techniques, it is desired to convert, by chemical reaction, the lignin in the wood, or part of the lignin, to a form in which it will dissolve in the cooking liquor. The liberation of substances from the cellulosic material, e.g. wood, during the digestion or cooking process is not selective and in addition to lignin some carbohydrates contained in the wood are also dissolved out in the cooking liquor.

If the lignin is removed from the wood to such an extent that the pulp can be exposed in individual fibres (defibration) with only a minor input of energy, the pulp is said to be a chemical pulp. With the most usual types of woods, such defibration can only be effected satisfactorily when the pulp is cooked down to a yield of about 45–54% (the defibration point) of the wood charged to the digester.

If the digestion process is interrupted at an earlier stage, resulting in a higher yield, the pulp is said to be semi-chemical. This pulp must be treated mechanically in order to expose the separate fibres. The amount of energy needed to beat semi-chemical pulp is much greater than that needed to beat chemical pulp. Furthermore, the strength properties of semi-chemical pulp are lower than those of chemical pulp.

The present invention relates to a method of producing a high yield pulp by the alkaline digestion of cellulosic material, wherein the beating energy required is not essentially greater than that required to beat a chemical pulp and wherein the strength properties of the pulp produced by the method are normally much higher than those of a conventional semi-chemical pulp of comparable quality. The method is based on the principle that subsequent to digesting the pulp for a certain period of time in a conventional manner, the pulp yield is increased by the precipitation of dissolved organic substances, chiefly lignin. The digestion process is then continued, conveniently at a temperature of at least 50°C, preferably 50°–200°C, for a suitable period of time, normally up to 300 minutes, conveniently from 15 to 240 minutes, suitably 30–120 minutes. During this time a large percentage of the previously dissolved substances is reabsorbed on the fibres of the pulp. If, prior to the precipitation stage, the pulp has been digested to beneath the defibration point, only an insignificant amount of energy is required to defibrate the final pulp. When practicing this method, pulp yields of 50–70% can be obtained with a screen reject of less than 1%, without subjecting the pulp to any appreciable degree of mechanical treatment.

It is known to the art that higher pulp yields can be obtained from alkaline cellulose digestion processes, by causing dissolved organic material to re-precipitate out onto the pulp (see for instance Swedish Pats. Nos. 222 020 and 317 250), precipitation of the organic material being effected by lowering the pH of the cooking liquor for example. The intention here, however, has been to re-precipitate only dissolved hemicellulose and other carbohydrates, and the procedural steps required herefor have been carried out in a manner such that no lignin precipitates out. The reason for this is apparently due to the belief prevailing among those skilled in this particular art that the re-precipitation of lignin onto the pulp fibres would impair the properties of the final pulp. It has been surprisingly discovered, however, that if, in accordance with the invention, the pH of the liquor is lowered to such an extent that significant quantities of lignin are re-precipitated out, not only is the pulp yield increased but a pulp with higher strength properties is also obtained.

The method according to this invention thus resides in the fact that subsequent to digesting the cellulosic material for a certain length of time, measures are taken whereby at least 5% (calculated on the cellulosic starting material) and preferably at least 10% of dissolved organic substances is precipitated out. When proceeding in this manner, significant quantities of lignin are precipitated out in addition to hemicellulose.

The re-precipitation of the aforementioned substances can be conveniently effected by lowering the pH of the cooking liquor, the pH in this particular instance being lowered to beneath 11, in order that significant quantities of lignin are precipitated out.

The pH of the cooking liquor is suitably lowered by introducing an acid thereto. This acid is preferably sulphuric acid although other inorganic or organic acids or acid salts may be used. The pH of the liquor may also be lowered by admixing the liquor with waste liquor obtained from an acid digestion process, whereupon the content of dissolved material of the cooking liquor is increased and an additional increase in yield is obtained. A lowering of the pH can also be obtained by introducing oxygen gas into the cooking liquor.

In order for the re-precipitation of dissolved substances to have any practical significance with regard to an increase in pulp yield, the digestion process should be continued to an extent corresponding to a pulp yield of approximately 65% (calculated on the wood), preferably 60%. The possible increase in yield afforded by the precipitation of substances dissolved in the cooking liquor becomes greater the longer the digestion process is continued. This increase, however, is also dependent on the extent to which the aforementioned re-precipitation of dissolved substances is carried out. A total increase in yield of 5–20% (calculated on the wood) is normally possible. As previously mentioned, if the pulp obtained is to be capable of being defibrated, the re-precipitation process should take place after the pulp has been cooked to beneath the defibration point, i.e. to a yield of 45–54%.

In order to increase the pulp yield still further, the method according to the invention can be combined with known methods for stabilizing carbohydrates, by reduction with borohydride, hydrogen sulphide or other reducing agents, or by oxidation with polysulphide or other oxidizing agents.

It is known that the amount of reabsorbable carbohydrates in the cooking liquor can be increased in this way. By applying these measures during the cooking process before the precipitation process in accordance with the invention, it is possible to increase the yield of pulp.

The invention will now be illustrated by a number of examples.

EXAMPLE 1

Commercially available birch chips were subjected to a sulphate cooking process in acid-proof autoclave tubes containing 350 gr of dry chips with a liquor-wood ratio of 4:1 and with a NaOH and $Na_2S$ charge of such magnitude that the alkali ratio, calculated as effective alkali, was 19% and the sulphidity 25%. The charge was made at 70°C. The digester temperature was raised linearly from 70°C to 160°C in 90 mins. The cooking time at 160°C was 150 mins, after which sulphuric acid was charged to the autoclave in an amount corresponding to 1.2 mols $H^+$/kg charged wood. The cooking was then continued at 150°C for a further 15 mins. The pulp was washed and screened and the yield determined. Certain strength properties of the pulp were also investigated. SCAN test methods were applied throughout.

| Result | With an acid addition | Without an acid addition |
|---|---|---|
| pH of cooking liquor | 9.5 | 12.6 |
| Total yield, % | 57.6 | 51.9 |
| Screen residue, % | 0.05 | 0.1 |

Strength properties after beating to 30°SR

| | Pulps with absorbed substances yield 57.6% | Pulps without absorbed substances yield 51.9% | Pulps without absorbed substances yield 57.2% |
|---|---|---|---|
| Beating revolutions PFI mill | 3000 | 3000 | 3300 |
| Wear length km | 10.1 | 8.8 | 8.8 |
| Tear factor | 84 | 87 | 81 |

EXAMPLE 2

Laboratory pine chips were subjected to a sulphate cooking process in acid-proof autoclave tubes containing 300 gr dry chips with a liquor-wood ratio of 4:1 and with a NaOH and $Na_2S$ charge of such magnitude that the alkali ratio, calculated as effective alkali was 17.5%, and the sulphidity 25%. The charge was made at 70°C. The digester temperature was raised linearly from 70°C to 170°C in 100 mins. The cooking time at 170°C was 2 hours, after which time sulphuric acid was charged to the autoclave in an amount corresponding to 1.3 mols $H^+$/kg charged wood. The cooking was then continued at 170°C for a further 20 mins. The pulp was washed and screened and the yield determined. Certain strength properties of the pulp were also investigated.

| Result | With an acid addition | Without an acid addition |
|---|---|---|
| pH of the cooking liquor | 10.0 | 12.4 |
| Total yield, % | 54.4 | 48.6 |
| Screen residue, % | 0 | 0 |

Strength properties at an air resistance in the sheet of 15 s/100 ml(according to Gurley)

| | Pulp with absorbed substance, yield 54.5% | Conventional sulphate pulp, yield 54.1% |
|---|---|---|
| Beating revolutions in PFI mill | 6,500 | 13,000 |
| Wear length, km | 9.6 | 8.6 |
| Tear factor | 128 | 146 |
| Burst factor | 80 | 74 |
| Double fold number | 2,800 | 2,300 |

EXAMPLE 3

Laboratory pine chips were subjected to a sulphate cooking process in accordance with example 2, although in this instance the acid addition was 2.0 mols $H^+$/kg of charged wood. Subsequent to charging the acid to the autoclave, the cooking was continued at 170°C for a further 180 mins, whereafter the pulp was washed and screened and the yield determined. Certain strength properties of the pulp were also investigated.

| Result | With an acid addition | Without an acid addition |
|---|---|---|
| pH of cooking liquor | 8.6 | 12.4 |
| Total yield | 62.9 | 48.6 |
| Screen residue, % | 0.2 | 0 |

Strength properties at an air resistance of 15 s/100 ml

| | Pulp with absorbed substance, yield 62.9% | Pulp without absorbed substance, yield 62.1% |
|---|---|---|
| Beating revolutions in PFI mill | 6,000 | 23,000 |
| Wear length, km | 9.5 | 7.1 |
| Tear factor | 100 | 100 |
| Burst factor | 81 | 60 |
| Double fold number | 2,500 | 1,650 |

EXAMPLE 4

Laboratory pine chips were subjected to a sulphate cooking process in accordance with Example 3. Subsequent to the addition of acid, the cooking was continued at 105°C for a further 90 mins, whereafter the pulp was washed and screened and the yield determined. Certain strength properties were also investigated.

| Result | With an acid addition | Without an acid addition |
|---|---|---|
| pH of the cooking liquor | 8.0 | 12.4 |
| Total yield, % | 62.7 | 48.6 |
| Screen residue, % | 0.5 | 0 |

Strength properties at an air resistance of 15 s/100 ml

| | Pulp with absorbed substance, yield 62.7% | Pulp without absorbed substance, yield 62.1% |
|---|---|---|
| Beating revolutions in PFI mill | 5,500 | 23,000 |
| Wear length, km | 9.5 | 7.1 |
| Burst factor | 76 | 60 |
| Double fold number | 2,500 | 1,650 |
| Tear factor | 115 | 100 |

EXAMPLE 5

Laboratory pine chips were subjected to a sulphate cooking process in accordance with example 3. Subsequent to the addition of acid, the cooking continued at 65°C for a further 60 mins, whereafter the pulp was washed and screened and the yield determined. Certain strength properties were also investigated.

| Result | With an acid addition | Without an acid addition |
|---|---|---|
| pH of cooking liquor | 7.8 | 12.4 |
| Total yield, % | 60.5 | 48.6 |
| Screen residue, % | 0 | 0 |

Strength properties at an air resistance of 15 s/100 ml

| | Pulp with absorbed substance, yield 60.5% | Pulp without absorbed substance, yield 59.6% |
|---|---|---|
| Beating revolutions in PFI mill | 4,500 | 30,000 |
| Wear length, km | 10.1 | 7.5 |
| Tear factor | 107 | 104 |
| Burst factor | 81 | 62 |
| Double fold number | 2,500 | 2,000 |

EXAMPLE 6

Laboratory pine chips were subjected to a sulphate cooking process according to Example 2. Subsequent to cooking the chips for 2 hrs at 170°C, sulphuric acid was charged to the autoclave in an amount corresponding to 3.0 mols $H^+$/kg of wood charged. The cooking was then continued for a further 15 mins at 170°C, whereafter the pulp was washed and screened and the yield determined. Certain strength properties were also investigated.

| Result | With an acid addition | Without an acid addition |
|---|---|---|
| pH of the cooking liquor | 5.4 | 12.4 |
| Total yield, % | 62.2 | 48.6 |
| Screen residue, % | 0.1 | 0 |

Strength properties at an air resistance of 15 s/100 ml.

| | Pulp with absorbed substance, yield 62.2% | Pulp without absorbed substance, yield 62.1% |
|---|---|---|
| Beating revolutions in PFI mill | 4,600 | 23,000 |
| Wear length, km | 10.3 | 7.1 |
| Tear factor | 118 | 100 |
| Burst factor | 89 | 60 |
| Double fold number | 2,500 | 1,650 |

EXAMPLE 7

Laboratory pine chips were subjected to a sulphate cooking process in accordance with Example 6, although in this instance the absorption time at 170°C was extended to 5 hrs. The pulp was then washed and screened and the yield determined. Certain strength properties were also investigated.

| Result | With an acid addition | Without an acid addition |
|---|---|---|
| pH of the cooking liquor | 5.6 | 12.4 |
| Total yield, % | 67.0 | 48.6 |
| Screen residue, % | 0.4 | 0 |

Strength properties at an air resistance of 15 s/100 ml

| | Pulp with absorbed substance, yield 67.0% | Pulp without absorbed substances, yield 67.4% |
|---|---|---|
| Beating revolutions in PFI mill | 8,500 | 26,000 |
| Wear length, km | 7.5 | 5.5 |
| Tear factor | 97 | 90 |
| Burst factor | 61 | 45 |
| Double fold number | 2,000 | 900. |

We claim:

1. In a method of preparing pulp by alkaline digestion of cellulosic material, the improvement which comprises digesting said cellulosic material containing organic substances in an alkaline digestion liquid at a temperature of from 50°C to 200°C to give a pulp yield of not above 65 percent, lowering the pH of the digestion liquid to below 11 in the presence of the pulp to precipitate out at least 5 percent, based on said cellulosic material, of organic substances dissolved in the digestion liquid, and then continuing said digestion at a temperature of 50°C to 200°C until a large percentage of said precipitated organic substances have been absorbed by the pulp during an absorption period.

2. A method according to claim 1, comprising adding an acid, such as sulphuric acid, to the cooking liquor to lower the pH of said liquor.

3. A method according to claim 1, comprising adding waste liquor from an acid cooking process to the cooking liquor to lower the pH of said liquor.

4. A method according to claim 1, comprising continuing the absorption period from 15 minutes to 300 minutes.

5. A method according to claim 1, wherein the digestion of said cellulosic material results in a pulp yield of about 45 to 54 percent, and whereby lignin is removed from said cellulosic material to such an extent that the pulp can be exposed in individual fibres.

6. A method according to claim 1, comprising stabilizing the carbohydrates during the cooking process by reduction with reducing agents prior to the precipitation process.

* * * * *